US011455967B2

(12) United States Patent
Tang et al.

(10) Patent No.: US 11,455,967 B2
(45) Date of Patent: Sep. 27, 2022

(54) OVERHAUL METHOD AND DRIVING METHOD FOR DISPLAY DEVICE AND DISPLAY DEVICE

(71) Applicant: HKC CORPORATION LIMITED, Shenzhen (CN)

(72) Inventors: Li Tang, Chongqing (CN); Feilin Ji, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 524 days.

(21) Appl. No.: 16/340,387

(22) PCT Filed: Jan. 29, 2019

(86) PCT No.: PCT/CN2019/073600

§ 371 (c)(1),
(2) Date: Apr. 9, 2019

(87) PCT Pub. No.: WO2020/133629

PCT Pub. Date: Jul. 2, 2020

(65) Prior Publication Data

US 2021/0327382 A1 Oct. 21, 2021

(30) Foreign Application Priority Data

Dec. 25, 2018 (CN) ..... 201811587044.3

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 2310/08* (2013.01)

(58) Field of Classification Search
CPC ... G09G 3/3677; G09G 3/006; G09G 2310/08
See application file for complete search history.

(56) References Cited

U.S. PATENT DOCUMENTS

2011/0148825 A1* 6/2011 Ueno ..... G09G 3/3677 345/204
2012/0206435 A1 8/2012 Liao

FOREIGN PATENT DOCUMENTS

CN 101201518 A 6/2008
CN 102074197 A 5/2011
CN 105096876 A 11/2015
CN 106157858 A 11/2016
CN 106959789 A 7/2017
(Continued)

OTHER PUBLICATIONS

International Search Report issued in corresponding international application No. PCT/CN2019/073600, dated Jan. 29, 2019.
(Continued)

*Primary Examiner* — Mark W Regn

(57) ABSTRACT

The present application discloses an overhaul method and a driving method for a display device and the display device. A display panel is provided with a first screen gate driving circuit and a second screen gate driving circuit which are respectively controlled by a first frame start signal L_STV and a second frame start signal R_STV which are independent of each other.

19 Claims, 5 Drawing Sheets

(56) References Cited

FOREIGN PATENT DOCUMENTS

| | | | |
|---|---|---|---|
| CN | 207781163 | * | 8/2018 |
| CN | 207781163 U | | 8/2018 |

OTHER PUBLICATIONS

Written Opinion of the International Searching Authority for No. PCT/CN2019/073600.
First Office Action from China patent office in a counterpart Chinese patent Application 201811587044.3, dated Mar. 19, 2020 (9 pages).

* cited by examiner

OVERHAUL METHOD AND DRIVING METHOD FOR DISPLAY DEVICE AND DISPLAY DEVICE

The present application claims priority to Chinese Patent Application No. CN 201811587044.3, entitled "OVERHAUL METHOD AND DRIVING METHOD FOR DISPLAY DEVICE AND DISPLAY DEVICE", filed to National Intellectual Property Administration, PRC on Dec. 25, 2018, the entire contents of which are incorporated herein by reference in the present application.

TECHNICAL FIELD

The present application relates to the technical field of display, and in particular, to an overhaul method and a driving method for a display device and the display device.

BACKGROUND

The statements herein merely provide background information a to the present application and do not necessarily constitute the prior art.

With the development and advancement of technology, liquid crystal displays have become mainstream display products due to their thin bodies, power saving and low radiation, etc, and have been widely used. Most of the liquid crystal displays on the market are backlight type liquid crystal displays which each include a liquid crystal panel and a backlight module. The working principle of a liquid crystal device is that liquid crystal molecules are placed between two parallel glass substrates, and a driving voltage is applied on the two glass substrates to control the rotating direction of the liquid crystal molecules, so as to refract light of the backlight module to generate a picture.

At present, most of the display devices adopt a double-sided screen gate driver on array (GOA) architecture. The display device based on a screen gate driving technology has the advantages of simple process and low cost and the like, and has gradually become a mainstream display device. However, in the actual production process, the display device is often subjected to single-sided screen gate driving circuit damage, and usually can only be scrapped, which reduces the yield of the display device.

SUMMARY

The present application provides an overhaul method and a driving method for a display de-ice capable of achieving single-sided driving and double-sided driving and the display device.

To achieve the above objective, the present application provides a display device including a display panel, a driving circuit, and a power supply for providing a voltage required for the display panel and the driving circuit. The display panel is provided with screen gate driving circuits for receiving a screen gate driving signal output by the driving circuit to a gate line in the display panel, and the screen gate driving circuits include a first screen gate driving circuit and a second screen gate driving circuit; the first screen gate driving circuit and the second screen gate driving circuit are located on two sides of the display panel respectively; the screen gate driving signal includes a first frame start signal and a second frame start signal independent of each other; the first frame start signal controls the first screen gate driving circuit, and the second frame start signal controls the second screen gate driving circuit.

In order to achieve the above objective, the present application further provides an overhaul method for a display device. The display device includes a display panel, a driving circuit, and a power source for providing a voltage required for the display panel and the driving circuit;

the display panel is provided with screen gate driving circuits for receiving a screen gate driving signal output by the driving circuit to drive a gate line in the display panel, and the screen gate driving circuits include a first screen gate driving circuit and a second screen gate driving circuit; the first screen gate driving circuit and the second screen gate driving circuit are located on two sides of the display panel respectively;

the screen gate driving signal includes a first frame start signal and a second frame start signal independent of each other; the first frame start signal controls the first screen gate driving circuit, and the second frame start signal controls the second screen gate driving circuit;

the overhaul method includes:

when it is detected that the screen gate driving circuit is normal, setting the first frame start signal and the second frame start signal output by the driving circuit to operating levels simultaneously;

when it is detected that the first screen gate driving circuit is damaged and the second screen gate driving circuit is normal, setting the first frame start signal output by the driving circuit to a non-operating level, and setting the second frame stall signal to an operating level;

when it is detected that the second screen gate driving circuit is damaged and the first screen gate driving circuit is normal, setting the second flame start signal to a non-operating level, and setting the first frame start signal to an operating level.

In order to achieve the above objective, the present application further provides a driving method for a display device. The display device includes a display panel, a driving circuit, and a power source for providing a voltage required for the display panel and the driving circuit;

the display panel is provided with screen gate driving circuits for receiving a screen gate driving signal output by the driving circuit to drive a gate line in the display panel, and the screen gate driving circuits include a first screen gate driving circuit and a second screen gate driving circuit; the first screen gate driving circuit and the second screen gate driving circuit are located on two sides of the display panel respectively;

the screen gate driving signal includes a first frame start signal and a second frame start signal independent of each other; the first frame start signal controls the first screen gate driving circuit, and the second frame start signal controls the second screen gate driving circuit;

the driving method includes:

when it is detected that the first frame start signal output by the driving circuit is a non-operating level, making the first screen gate driving circuit not operate;

when it is detected that the first frame start signal output by the driving circuit is an operating level, causing the first screen gate driving circuit to operate normally;

when it is detected that the second frame start signal output by the driving circuit is a non-operating level, making the second screen gate driving circuit not operate; and when it is detected that the second frame start signal output by the driving circuit is an operating level, causing the second screen gate driving circuit to operate normally;

where the first frame start signal and the second frame start signal are independent of each other.

Compared with a solution in which the driving circuit only outputs a one-frame start signal and two screen gate driving circuits on the left and right of the display panel operate, the first frame start signal and the second frame start signal output by the driving circuit of the display device according to the present application are independent of each other; the first frame start signal controls the first screen gate driving circuit disposed on one side of the display panel, and the second frame start signal controls the second screen gate driving circuit disposed on the other side of the display panel, so that the first screen gate driving circuit and the second screen gate driving circuit are controlled independently; and the first screen gate driving circuit and the second screen gate driving circuit on the two sides of the display panel can operate simultaneously. If the first screen gate driving circuit is damaged, the normal operation of the second screen gate driving circuit is not affected. Therefore, if the single-sided screen gate driving circuit is damaged due to electrostatic discharge or the like, the screen gate driving circuit on the other side is not affected and scrapped. The display panel can be driven bilaterally or independently on one side, which can improve the yield of the display device.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

The specific structure and function details disclosed herein are merely representative, and are intended to describe exemplary embodiments of the present application. However, the present application can be specifically embodied in many alternative forms, and should not be interpreted to be limited to the embodiments described herein.

Figure 1:
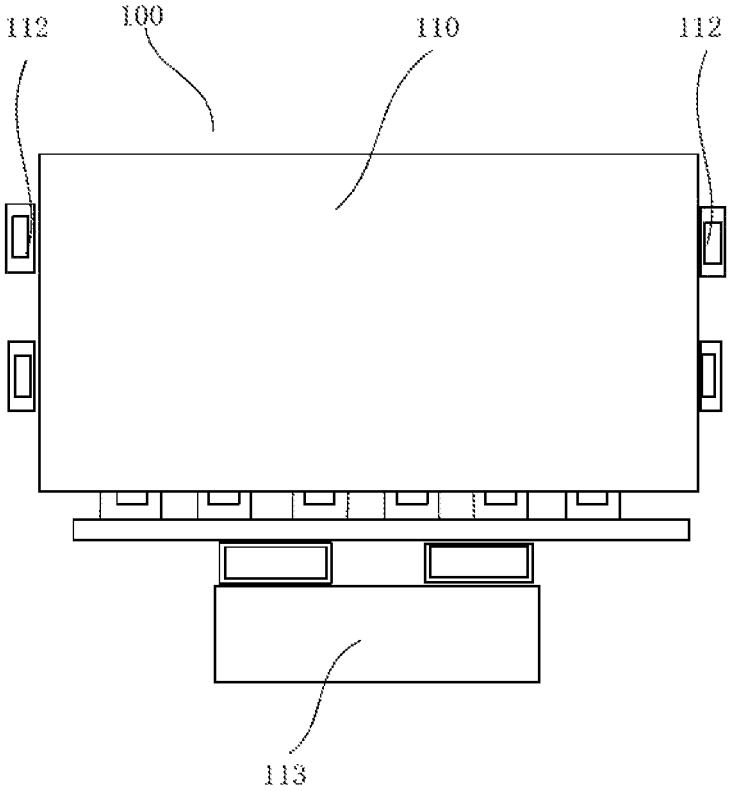
FIG. 1 is a schematic view of a display device according to an embodiment of the present application.
Figure 2:
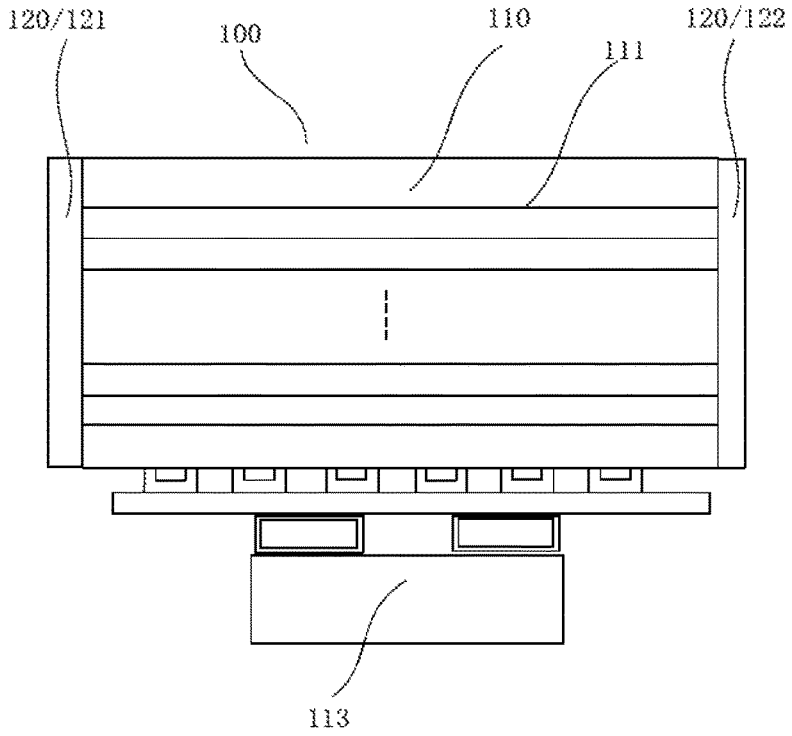
FIG. 2 is a schematic view of another display device according to an embodiment of the present application.

As shown in FIGS. 1 to 2, the left and right sides of a large-sized liquid crystal display device 100 are often provided with gate driving circuits 112 for double-sided driving. With the development of technology, it has become a trend to set functions of the gate driving circuit 112 in plane, and screen gate driving circuit 120 products have been successively developed.

The process of screen gate driving on a conventional control panel 113 includes that a power supply chip 151 converts an input voltage to obtain a voltage required by a timing controller 131 and a level shifter 132, and the timing controller 131 outputs a logic level signal 143 to the level shifter 132; the logic level signal 143 is converted into a screen gate driving signal 140 with a high level turn-on TFT voltage VGH and a low level turn-off TFT voltage VGL, and the screen gate driving signal 140 is transmitted to screen gate driving circuits 120 on the left side and right side of a display device 100; a gate line 111 in a display panel 110 is driven line by line after the screen gate driving circuits 120 operate normally. However, in the actual production process, there is often a display device 100 in which a single-sided screen gate driving circuit 120 is damaged due to electrostatic discharge or other process factors. The display device 100 usually can only be scrapped.

The present application will be thither described below with reference to the accompanying drawings and embodiments.

Figure 3:
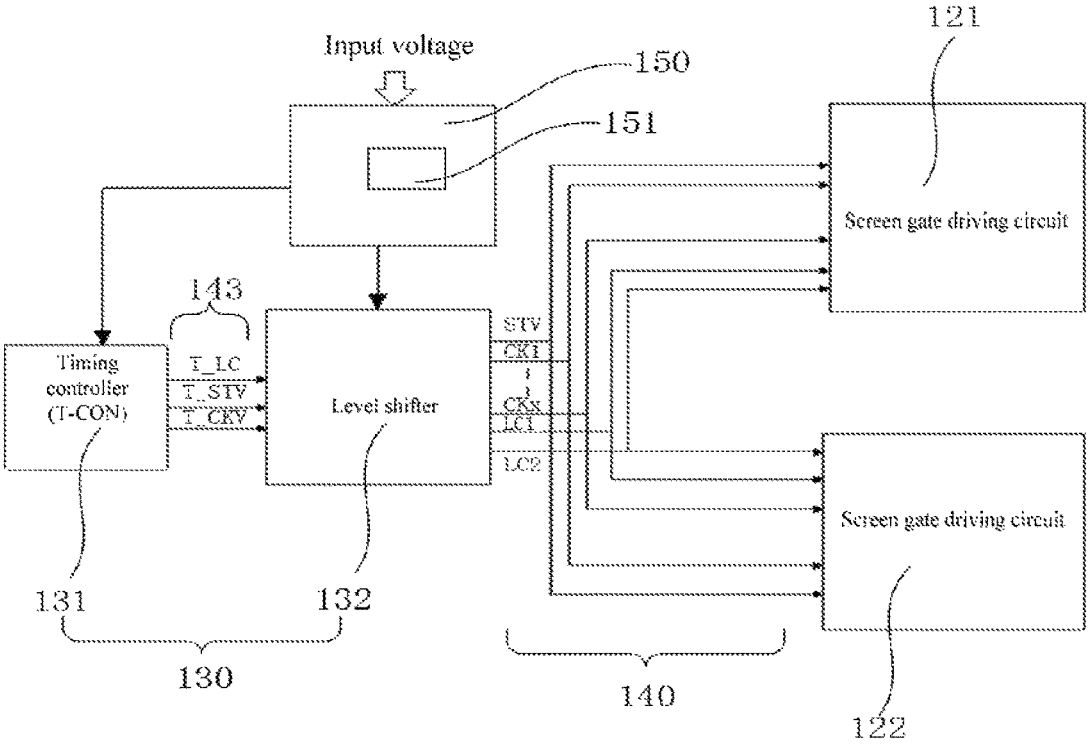
FIG. 3 is a schematic view of a driving method for a display device according to an embodiment of the present application.
Figure 4:
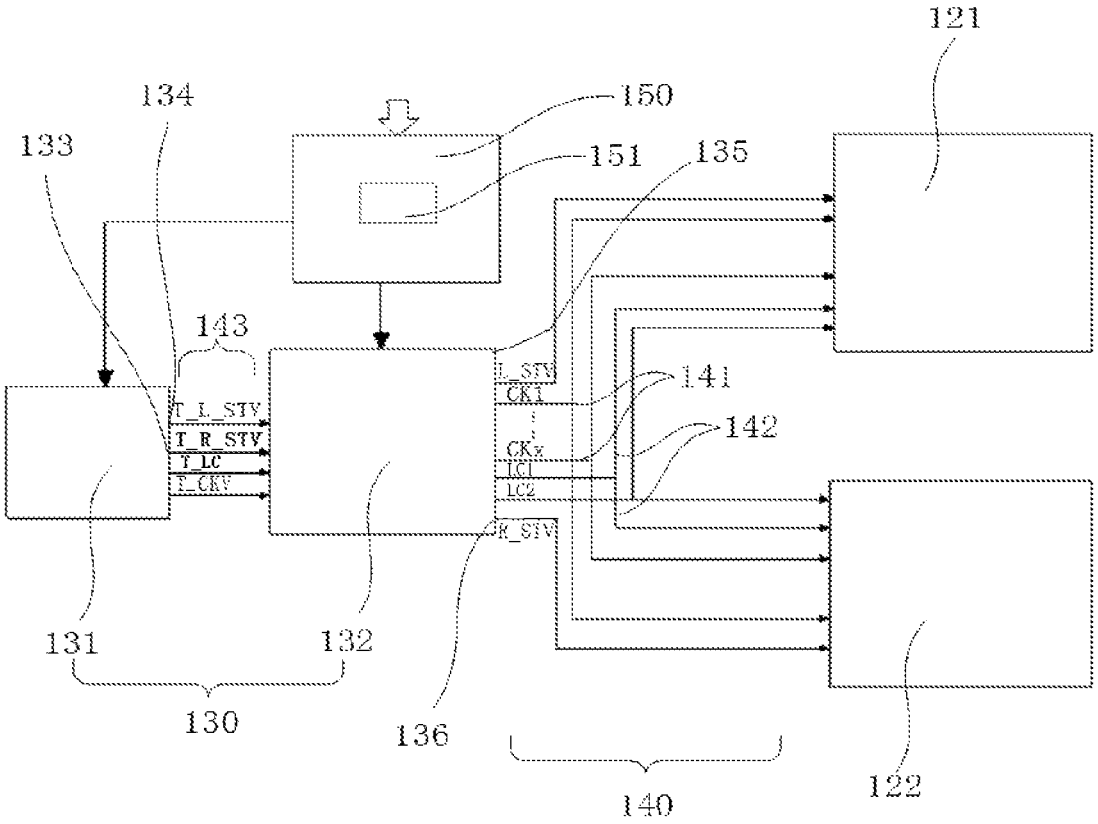
FIG. 4 is a schematic view of a driving method for another display device according to an embodiment of the present application.

In an embodiment of the present application, with reference to FIG. 2 to FIG. 4, a display device 100 is disclosed, including a display panel 110, a driving circuit 130, and a power supply 150 for providing a voltage required by the display panel 110 and the driving circuit 130. The power supply 150 is internally provided with a power supply chip 151 for receiving and distributing an externally supplied voltage. The display panel 110 is provided with screen gate driving circuits 120 for receiving a screen gate driving signal 140 output by the driving circuit 130 to drive a gate line 111 in the display panel 110. The screen gate driving circuits 120 include a first screen gate driving circuit 121 and a second screen gate driving circuit 122. The first screen gate driving circuit 121 and the second screen gate driving circuit 122 are located on the two sides of the display panel 110 respectively. The screen gate driving signal 140 includes a first frame start signal L_STV and a second frame start signal R_STV which are independent of each other; the first frame start signal L_STV controls the first screen gate driving circuit 121, and the second frame start signal R_STV controls the second screen gate driving circuit 122; and specifically, the screen gate driving signal 140 includes a high level turn-on TFT voltage VGH and a low level turn-off TFT voltage VGL.

The first frame start signal L_STV and the second frame start signal R_STV which are output by the driving circuit 130 of the display device 100 are independent of each other; the first frame start signal L_STV controls the first screen gate driving circuit 121 disposed on one side of the display panel 110, and the second frame start signal R_STV controls the second screen gate driving circuit 122 disposed on the other side of the display panel 110, so that the first screen gate driving circuit 121 and the second screen gate driving circuit 122 are controlled independently, and the first screen gate driving circuit 121 and the second screen gate driving circuit 122 on the two sides of the display panel 110 can operate simultaneously. If the first screen gate driving circuit 121 is damaged, the normal operation of the second screen gate driving circuit 122 is not affected. Therefore, the display device 100 is protected from the scrapping caused by the damage of the single-sided screen gate driving circuit 120. The display panel 110 can be driven bilaterally or independently on one side, which can improve the yield of the display device 100.

In an embodiment, the driving circuit 130 includes a timing controller 131 and a level shifter 132. The timing controller 131 outputs a logic level signal 143, and the level shifter 132 receives the logic level signal 143 output by the timing controller 131 and converts the logic level signal 143 into a screen gate driving signal 140; the logic level signal 143 output by the timing controller 131 includes a first frame start timing control signal T_L_STV and a second frame start timing control signal T_R_STV independent of each other; the level shifter 132 receives the first frame start timing control signal T_L_STV to output a first frame start signal L_STV, and the level shifter 132 receives the second frame stall timing control signal T_R_STV to output a second frame start signal R_STV.

The drive circuit 130 is composed of the timing controller 131 and the level shifter 132. The timing controller 131 outputs a logic level signal 143, and the level shifter 132 receives the logic level signal 143 output by the timing controller 131. Since the driving circuit 130 is to output the first frame start signal L_STV and the second frame start signal R_STV, the timing controller 131 needs to first output the first frame start timing control signal T_L_STV and the second frame start timing control signal T_R_STV independent of each other, and the first frame start timing control signal T_L_STV and the second frame start timing control signal T_R_STV are received by the level shifter 132 and then correspondingly converted into the first frame start signal L_STV and the second frame stall signal R_STV independent of each other.

In an embodiment, the timing controller 131 includes a first general purpose input/output port 133 and a second general purpose input/output port 134; the first general purpose input/output port 133 outputs the first frame start timing control signal T_L_STV to the level shifter 132 and the second general purpose input/output port 134 outputs the second frame start timing control signal T_R_STV to the level shifter 132. An output signal of the timing controller 131 depends on a corresponding port for output. Since the first frame start timing control signal T_L_STV and the second frame start timing control signal T_R_STV are independent of each other, two ports, namely the first general purpose input/output port 133 and the second general purpose input/output port 134, are needed for output. Therefore, the first flame start timing control signal T_L_STV is output to the level shifter 132 through the first general purpose input/output port 133, and the second frame start timing control signal T_R_STV iso output to the level shifter 132 through the second general purpose input/output port 134.

In an embodiment, the level shifter 132 includes a first low frequency port 135 and a second low frequency port 136; the level shifter 132 converts the first frame start timing control signal T_L_STV into the first frame start signal L_STV, and transmits the first frame start signal L_STV to the first screen gate driving circuit 121 through the first low frequency port 135; and the level shifter 132 converts the second frame start timing control signal T_R_STV into the second frame start signal R_STV, and transmits the second frame start signal R_STV to the second screen gate driving circuit 122 through the second low frequency port 136.

An output signal of the level shifter 132 needs to rely on the corresponding port for output. Since the first frame start signal L_STV and the second frame start signal R_STV are independent of each other, two ports, namely the first low frequency port 135 and the second low frequency port 136, are required for output. Therefore, the level shifter 132 converts the received first frame start timing control signal T_L_STV into the first frame start signal L_STV, and then transmits the first frame start signal L_STV to the first screen gate driving circuit 121 through the first low frequency port 135; and the level shifter 132 converts the received second frame start timing control signal T_R_STV into the second frame start signal R_STV, and transmits the second frame start signal R_STV to the second screen gate driving circuit 122 through the second low frequency port 136.

Specifically, the timing controller 131 and the level shifter 132 do not require an additional corresponding module to output the first frame start signal L_STV and the second frame start signal R_STV, and this embodiment does not need to adopt an additional external control pin to control logic signal output, but adopts a lighting device the same as an external lighting device of an ordinary GOA liquid crystal panel, which saves production costs.

In an embodiment, a logic level signal 143 output by the timing controller 131 includes a clock control signal T_CKV and a low frequency clock control signal T_LC, and the level shifter 132 converts the clock control signal T_CKV into clock signals 141, specifically including CK1, CK2 to CKx, where x>1; the level shifter 132 converts the low frequency clock control signal T_LC into low frequency clock signals 142, specifically including LC1 and LC2, and the clock signals 141 and the low frequency clock signals 142 are transmitted to the first screen gate driving circuit 121 and the second screen gate driving circuit 122 respectively through x+2 output ports on the level shifter 132; and lines through which the clock signals 141 and the low frequency clock signals 142 are transmitted to the first screen gate driving circuit 121 and the second screen gate driving circuit 122 are the same.

The lines through which the clock signals 141 and the low frequency clock signals 142 are transmitted to the first screen gate driving circuit 121 and the second screen gate driving circuit 122 are the same, which reduces the number of lines between a signal output end of the level shifter 132 and the first screen gate driving circuit 121 and the second screen gate driving circuit 122, so that the size of chips inside the level shifter 132 is reduced, thereby saving production costs.

Figure 5:
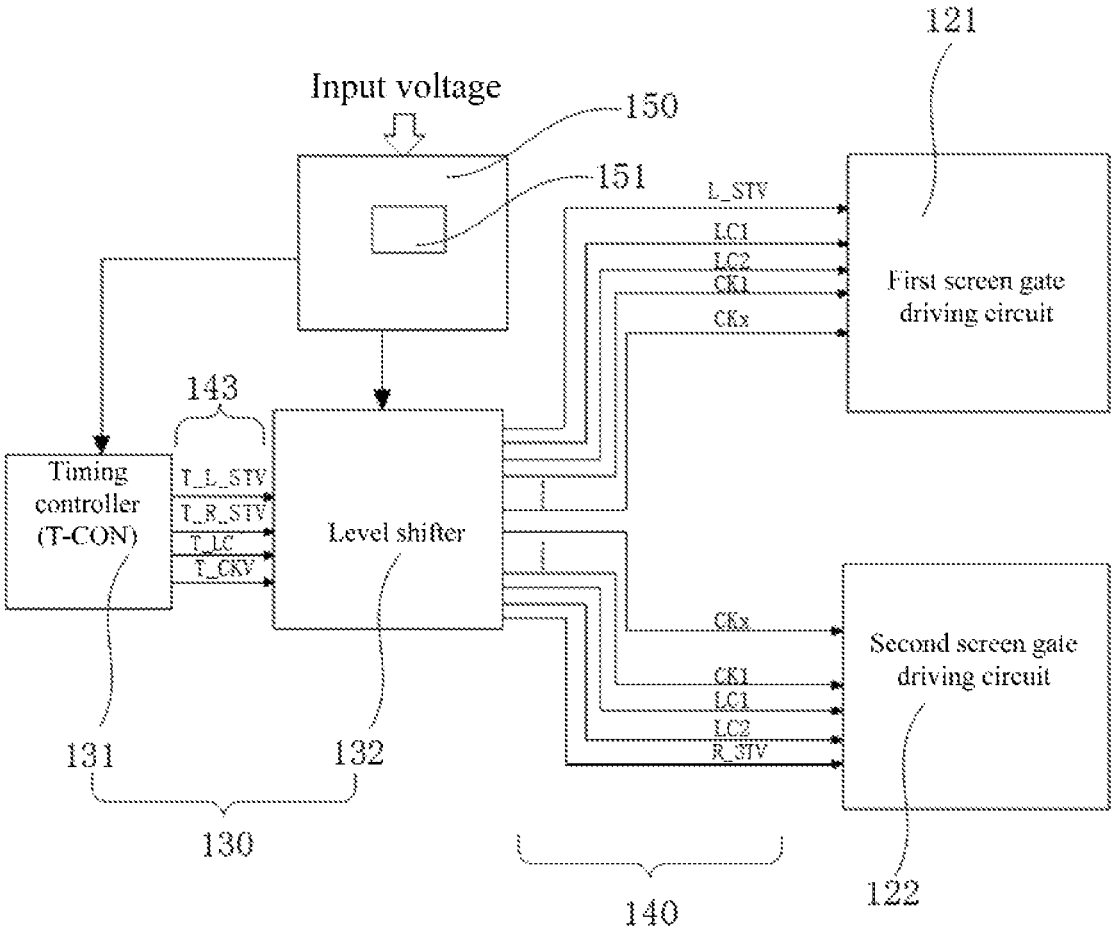
FIG. 5 is a schematic view of a driving method for another display device according to an embodiment of the present application.
Figure 6:
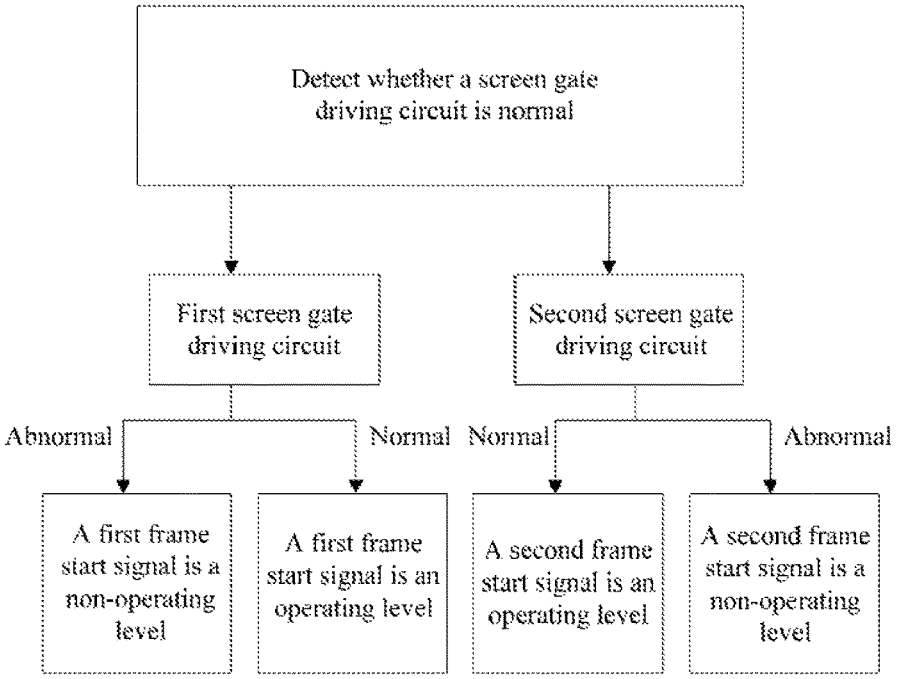
FIG. 6 is a schematic flow chart of an overhaul method for a display device according to an embodiment of the present application.
Figure 7:
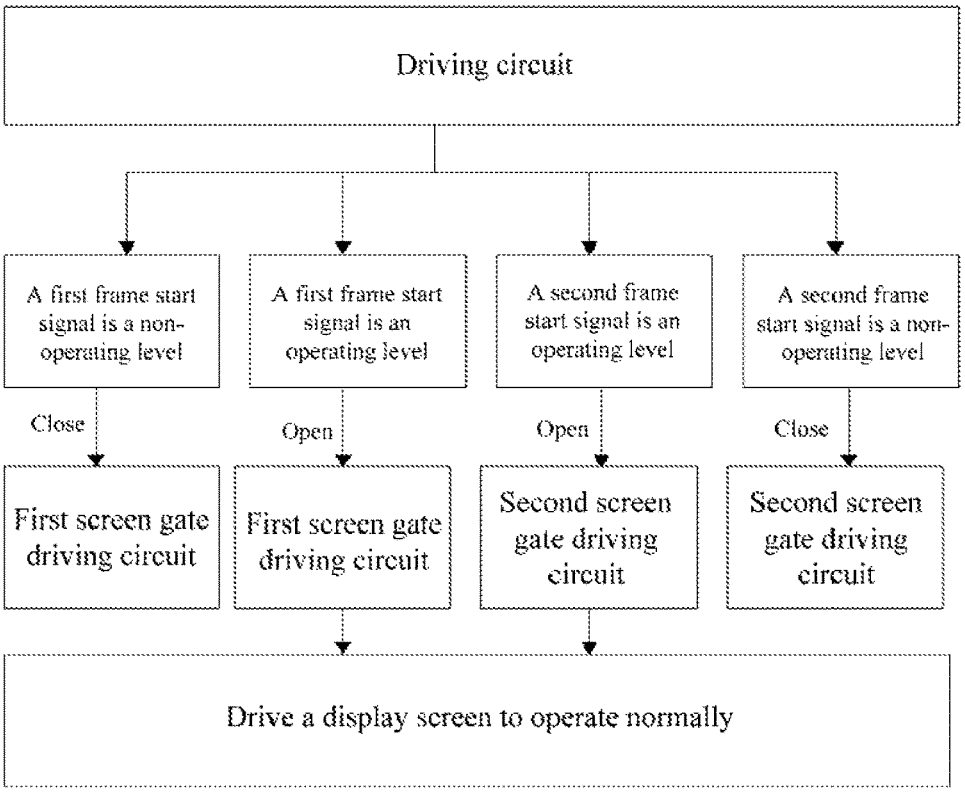
FIG. 7 is a schematic flow chart of a driving method for a display device according to an embodiment of the present application.

Referring to FIG. 5, the difference from the above embodiment is that the logic level signal 143 output by the timing controller 131 includes a clock control signal and a low frequency clock control signal, and the level shifter 132 converts the clock control signal into clock signals 141, specifically including CK1, CK2 to CKx, where x>1; the level shifter 132 converts the low frequency clock control signal into low frequency clock signals 142, specifically including LC1 and LC2, and the level shifter 132 includes 2x+4 output ports: the clock signals 141 and the low frequency clock signals 142 are transmitted to the first screen gate driving circuit 121 and the second screen gate driving circuit 122 respectively through the 2x+4 output ports on the level shifter 132, and transmission lines between the level shifter 132 and first the screen gate driving circuit 121 and the second screen gate driving circuit 122 are independent of each other.

The clock signals 141 and the low frequency clock signals 142 transmitted to the first screen gate driving circuit 121 and the second screen gate driving circuit 122 through the level shifter 132 are transmitted by mutually independent output ports, so that the damage of transmission lines for the clock signals 141 and the low frequency clock signals 142 between the level shifter 132 and the single-sided screen gate driving circuit 120 is prevented from affecting the clock signals 141 and the low frequency clock signals 142 of the other side screen gate driving circuit 120, thereby ensuring that the screen gate driving circuit 120 can be driven bilaterally or independently on one side.

In another embodiment of the present application, with reference to FIG. 2 to FIG. 4, a display device 100 is disclosed, including a display panel 110, a driving circuit 130, and a power supply 150 for providing a voltage required by the display panel 110 and the driving circuit 130. The display panel 110 is provided with a screen gate driving circuit 120 for receiving screen gate driving signals 140 output by the driving circuit 130 to start a gate line 111 in the display panel 110. The screen gate driving circuits 120 include a first screen gate driving circuit 121 and a second screen gate driving circuit 122. The first screen gate driving circuit 121 and the second screen gate driving circuit 122 are located on the two sides of the display panel 110 respectively;

the driving circuit 130 includes a timing controller 131 and a level shifter 132; the timing controller 131 outputs a logic level signal 143, and the logic level signal 143 output by the timing controller 131 includes a first frame start timing control signal T_L_STV and a second frame start timing control signal T_R_STV independent of each other; the screen gate driving signal 140 includes a first frame start signal L_STV and a second frame start signal R_STV independent of each other; the level shifter 132 receives the first frame stall timing control signal T_L_STV to output the first frame start signal L_STV, and the level shifter 132 receives the second frame start timing control signal T_R_STV to output the second frame start signal R_STV;

the timing controller 131 includes a first general purpose input/output port 133 and a second general purpose input/output port 134; the first general purpose input/output port 133 outputs the first frame start timing control signal T_L_STV to the level shifter 132, and the second general purpose input/output port 134 outputs the second frame start timing control signal T_R_STV to the level shifter 132;

the level shifter 132 includes a first low frequency port 135 and a second low frequency port 136; the level shifter 132 converts the first frame start timing control signal T_L_STV into the first frame start signal L_STV, and transmits the first frame start signal L_STV to the first screen gate driving circuit 121 through the first low frequency port 135; and the level shifter 132 converts the second frame start timing control signal T_R_STV into the second frame start signal R_STV, and transmits the second frame start signal R_STV to the second screen gate driving circuit 122 through the second low frequency port 136; the first frame start signal L_STV controls the first screen gate driving circuit 121, and the second frame start signal R_STV controls the second screen gate driving circuit 122;

a logic level signal 143 output by the timing controller 131 includes a clock control signal T_CKV and a low frequency clock control signal T_LC, and the level shifter 132 converts the clock control signal T_CKV into clock signals 141, specifically including CK1, CK2 to CKx, where x>1; the level shifter 132 converts the low frequency clock control signal T_LC into low frequency clock signals 142, specifically including LC1 and LC2, and the clock signals 141 and the low frequency clock signals 142 are transmitted to the first screen gate driving circuit 121 and the second screen gate, driving circuit 122 respectively through x+2 output ports on the level shifter 132; and lines for the clock signals 141 and the low frequency clock signals 142 to be transmitted to the first screen gate driving circuit 121 and the second screen gate driving circuit 122 are the same; specifically, the screen gate driving signal 140 includes a high level turn-on TFT voltage VGH and a low level turn-off TFT voltage VGL.

The timing controller 131 in the driving circuit 130 transmits the first frame start timing control signal T_L_STV and a second frame start timing control signal T_R_STV independent of each other to the level shifter 132 respectively though the first general purpose input/output port 133 and the second general purpose input/output port 134; other logic level signals 143 output by the timing controller 131 are also transmitted to the level shifter 132 respectively through respective ports, and the level shifter 132 converts the logic level signal 143 transmitted by the timing controller 131 to obtain a first frame start signal L_STV, a second frame start signal R_STV and corresponding clock signals 141 and low frequency clock signals 142; the clock signals 141 and the low frequency clock signals 142 are simultaneously transmitted to the first screen gate driving circuit 121 and the second screen gate driving circuit through the respectively corresponding ports; the first frame start signal L_STV and the second frame start signal R_STV are independently transmitted to the first screen gate driving circuit 121 and the second screen gate driving circuit through the first low frequency port 135 and the second low frequency port 136, and the first screen gate driving circuit 121 and the second screen gate driving circuit are controlled independently, so that operating states of the first screen gate driving circuit 121 and the second screen gate driving circuit do not interfere with each other, thereby achieving double-sided driving and single-sided driving of the display panel 110.

As shown in FIG. 2 to FIG. 4 and FIG. 6, another embodiment of the present application discloses an overhaul method for a display device 100, including:

when it is detected that a screen gate driving circuit 120 is normal, setting a first frame start signal L_STV and a second frame start signal R_STV output by a driving circuit 130 to operating levels simultaneously;

when it is detected that a first screen gate driving circuit 121 is damaged and a second screen gate driving circuit 122 is normal, setting the first frame start signal L_STV output by the driving circuit 130 to a non-operating level, and setting the second frame start signal R_STV to an operating level;

when it is detected that the second screen gate driving circuit 122 is damaged and the first screen gate driving circuit 121 is normal, setting the second frame start signal R_STV output by the driving circuit 130 to a non-operating level, and setting the first frame start signal L_STV to an operating level;

specifically, a screen gate driving signal 140 includes a high level turn-on TFT voltage VGH and a low level turn-off TFT voltage VGL.

After the display device 100 is manufactured, overhaul work needs to be performed. When it is detected that screen gate driving circuits 120 on the two sides of the display panel 110 operate normally, the first frame start signal L_STV and the second frame start signal R_STV output by the driving circuit 130 are simultaneously operating levels, so that the normal screen gate driving circuits 120 on the two sides of the display panel 110 can be controlled to implement double-sided driving; when it is detected that only one of the first screen gate driving circuit 121 and the second screen gate driving circuit is damaged, a frame start signal received by the damaged screen gate driving circuit is a non-operating level, and thus the damaged screen gate driving circuit 120 does not operate; a frame start signal received by the normal screen gate driving circuit is an operating level, and thus the normal screen gate driving circuit 120 operates, thereby achieving single-sided driving.

As shown in FIG. 2 to FIG. 4 and FIG. 7, another embodiment of the present application discloses a driving method for a display device 100, including:

when it is detected that a first frame start signal L_STV output by a driving circuit 130 is a non-operating level, making a first screen gate driving circuit 121 not operate;

when it is detected that the first frame start signal L_STV output by the driving circuit 130 is an operating level, causing the first screen gate driving circuit 121 to operate normally;

when it is detected that a second frame start signal R_STV output by the driving circuit 130 is a non-operating level, making a second screen gate driving circuit 122 not operate;

when it is detected that the second frame start signal R_STV output by the driving circuit 130 is an operating level, causing the second screen gate driving circuit 122 to operate normally;

where the first frame start signal L_STV and the second frame start signal R_STV are independent of each other.

A frame start signal output by the driving circuit 130 is used to control an operating state of the screen gate driving circuit 120. If the output first frame start signal L_STV is a non-operating level, the first screen gate driving circuit 121 does not operate, and if the output first frame start signal L_STV is an operating level, the first screen gate driving circuit 121 operates normally; similarly, if the output second frame start signal R_STV is a non-operating level, the second screen gate driving circuit 122 does not operate; if the output second frame start signal R_STV is an operating level, the first screen gate driving circuit 121 operates normally; the first frame start signal L_STV and the second frame start signal R_STV are independent of each other, indicating that the operation and no operation of the first screen gate driving circuit 121 and the operation and no operation of the second screen gate driving circuit 122 do not affect each other; if the circuits both operate, double-sided driving is implemented; if only one circuit operates, single-sided driving is implemented; and if no circuit operates, the display device 100 needs to be scrapped.

In an embodiment, when it is detected that the first frame start signal L_STV output by the driving circuit 130 is a non-operating level, the timing controller 131 outputs a low-level first frame start timing control signal T_L_STV through a first general purpose input/output port 133, and the first frame start timing control signal T_L_STV is converted into the first frame stall signal L_STV of a non-operating level; the non-operating level of the first frame start signal L_STV is received by the first screen gate driving circuit 121 through a first low frequency port 135, and the first screen gate driving circuit 121 does not operate;

when it is detected that the first frame start signal L_STV output by the driving circuit 130 is an operating level, the timing controller 131 outputs a normal first frame start timing control signal T_L_STV through a first general purpose input/output port 133, and the first frame start timing control signal T_L_STV is converted into a first frame start signal L_STV of an operating level through a first low frequency port 135 of the level shifter 132; the operating level of the first frame start signal L_STV is received by the first screen gate driving circuit 121, and the first screen gate driving circuit 121 operates;

when it is detected that the second frame start signal R_STV output by the driving circuit 130 is a non-operating level, the timing controller 131 outputs a low-level second frame start timing control signal T_R_STV through a second general purpose input/output port 134, and the second frame start tuning control signal T_R_STV is converted into a second frame start signal R_STV of a non-operating level through a second low frequency port 136 of the level shifter 132; the non-operating level of the second frame start signal R_STV is received by the second screen gate driving circuit 122, and the second screen gate driving circuit 122 does not operate;

when it is detected that the second frame start signal R_STV output by the driving circuit 130 is an operating level, the timing controller 131 outputs a normal second frame start timing control signal T_R_STV through a second general purpose input/output port 134, and the second frame start timing control signal T_R_STV is converted into a second frame start signal R_STV of an operating level through a second low frequency port 136 of the level shifter 132; the operating level of the second frame start signal R_STV is received by the second screen gate driving circuit 122, and the second screen gate driving circuit 122 operates.

Therefore, when the first screen gate driving circuit 121 and the second screen gate driving circuit 122 are both normal, the timing controller 131 outputs a first frame start timing control signal T_L_STV and a second frame start timing control signal T_R_STV respectively through the first general purpose input/output port 133 and the second general purpose input/output port 134; the first frame start timing control signal T_L_STV and the second frame start timing control signal T_R_STV are converted into a first frame start signal L_STV and a second frame start signal R_STV respectively through a first low frequency port 135 and a second low frequency port 136 of the level shifter 132; the first frame start signal L_STV and the second frame start signal R_STV each include a high level turn-on TFT voltage and a low level turn-off TFT voltage; the first frame start signal L_STV and the second frame start signal R_STV respectively operate the first screen gate driving circuit 121 and the second screen gate driving circuit 122 located on the two sides of the display device 100;

when the first screen gate driving circuit 121 is damaged and the second screen gate driving circuit 122 is normal, a first frame start timing control signal T_L_STV output by the timing controller 131 is a low level, and the first frame start timing control signal T_L_STV is converted into a first frame start signal L_STV through a first low frequency port 135 of the level shifter 132; the first frame start signal L_STV is only a low level turn-off TFT voltage, and the first screen gate driving circuit 121 does not operate; a second frame start timing control signal T_R_STV output by the timing controller 131 is converted into a second frame start signal R_STV through a second low frequency port 136 of the level shifter 132; the second frame start timing control signal T_R_STV includes a high level turn-on TFT voltage and a low level turn-off TFT voltage, and the second frame start signal R_STV operates the second screen gate driving circuit 122;

when the second screen gate driving circuit 122 is damaged and the first screen gate driving circuit 121 is normal, a first frame start timing control signal T_L_STV output by the timing controller 131 is converted into a first frame start signal L_STV through a first low frequency port 135 of the level shifter 132; the first frame start signal L_STV includes a high level turn-on TFT voltage and a low level turn-off TFT voltage; the first frame start signal L_STV operates the second screen gate driving circuit 122, and a second frame start timing control signal T_R_STV output by the timing controller 131 is a low level; the second frame start timing control signal T_R_STV is converted into a second frame start signal R_STV through the second low frequency port 136 of the level shifter 132; the second frame start signal R_STV is only a low level turn-off TFT voltage, and the second screen gate driving circuit 122 does not operate;

when the first screen gate driving circuit 121 and the second screen gate driving circuit 122 are both damaged, the display device 100 cannot be driven and is discarded.

The panel of the present application may be a twisted nematic (TN) panel, an in-plane switching (IPS) panel, or a multi-domain vertical alignment (VA) panel, and of course, the panel may also be other types of panels, as long as the panels are suitable.

The above are further detailed descriptions of the present application in conjunction with the specific embodiments, but the embodiments of the present application are not limited to these descriptions. For a person of ordinary skill in the art to which the present application pertains, a number of simple deductions or substitutions may also be made without departing from the concept of the present application. All these should be considered as falling within the scope of protection of the present application.

What is claimed is:

1. A display device, comprising a display panel, a driving circuit, and a power source configured for providing a voltage required by the display panel and the driving circuit;

the display panel comprises screen gate driving circuits configured for receiving a screen gate driving signal output by the driving circuit to drive a gate line in the display panel, and the screen gate driving circuits comprise a first screen gate driving circuit and a second screen gate driving circuit; the first screen gate driving circuit and the second screen gate driving circuit are disposed on two sides of the display panel respectively;

the screen gate driving signal comprises a first frame start signal and a second frame start signal independent of each other; the first frame start signal is configured to control the first screen gate driving circuit, and the second frame start signal is configured to control the second screen gate driving circuit;

wherein each of the first screen gate driving circuit and the second screen gate driving circuit is coupled to all gate lines of the display panel;

wherein in response to detecting that the first screen gate driving circuit and the second screen gate driving circuit are both functioning normally, setting both the first frame start signal and the second frame start signal output by the driving circuit to operating levels simultaneously and both the first screen gate driving circuit and the second screen gate driving circuit are operating simultaneously to synchronously perform double-sided driving, with each of the first screen gate driving circuit and the second screen gate driving circuit driving all the gate lines of the display panel.

2. The display device according to claim 1, wherein the driving circuit comprises a timing controller and a level shifter; the timing controller is configured to output a logic level signal, and the level shifter is configured to receive the logic level signal output by the timing controller and convert the logic level signal into a screen gate driving signal;

wherein the logic level signal output by the timing controller comprises a first frame start timing control signal and a second frame start timing control signal independent of each other; the level shifter is configured to receive the first frame start timing control signal to output the first frame start signal, and is further configured to receive the second frame start timing control signal to output the second frame start signal.

3. The display device according to claim 2, wherein the timing controller comprises a first general purpose input/output port and a second general purpose input/output port; the first general purpose input/output port is configured to output the first frame start timing control signal to the level shifter, and the second general purpose input/output port is configured to output the second frame start timing control signal to the level shifter.

4. The display device according to claim 3, wherein the level shifter comprises a first low frequency port and a second low frequency port; the level shifter is configured to convert the first frame start timing control signal into the first frame start signal, and transmit the first frame start signal to the first screen gate driving circuit through the first low frequency port; and the level shifter is configured to convert the second frame start timing control signal into the second frame start signal, and transmit the second frame start signal to the second screen gate driving circuit through the second low frequency port.

5. The display device according to claim 1, wherein the logic level signal output by the timing controller comprises a clock control signal and a low frequency clock control signal, and the level shifter is configured to convert the clock control signal into clock signals and transmit the clock signals to the first screen gate driving circuit and second screen gate driving circuit; the level shifter is configured to convert the low frequency clock control signal into low frequency clock signals and transmit the low frequency clock signals to the first screen gate driving circuit and second screen gate driving circuit; and wherein lines through which the level shifter transmits the clock signals and the low frequency clock signals to the first screen gate driving circuit and the second screen gate driving circuit are the same between the first screen gate driving circuit and the second screen gate driving circuit, wherein the first screen gate driving circuit and the second screen gate driving circuit are each coupled to the same set of transmission lines, which is led out of the level shifter and configured to transmit the clock signals and the low frequency clock signals.

6. The display device according to claim 5, wherein the lines comprise a set of clock signal lines and a set of low-frequency clock signal lines.

7. The display device according to claim 6, wherein the set of low-frequency clock signal lines comprise two low-frequency clock signal lines.

8. The display device according to claim 5, wherein the clock signals received by the first screen gate driving circuit and the clock signals received by the second screen gate driving circuit have the same timings, and wherein the low-frequency clock signals received by the first screen gate driving circuit and the low-frequency clock signals received by the second screen gate driving circuit have the same timings.

9. The display device according to claim 5, wherein one set of clock signal lines is led out of the level shifter, and each of the clock signal lines is branched into a first clock signal line that is fed into the first screen gate driving circuit and a second clock signal line that is fed into the second screen gate driving circuit; and wherein one set of low-frequency clock signal lines is led out of the level shifter, and each of the low-frequency clock signal lines is branched into a first low-frequency clock signal line that is fed into the first screen gate driving circuit and a second low-frequency clock signal line that is fed into the second screen gate driving circuit.

10. The display device according to claim 1, wherein the logic level signal output by the timing controller comprises a clock control signal and a low frequency clock control signal, and the level shifter is configured to convert the clock control signal into clock signals and transmit the clock signals to the first screen gate driving circuit and second screen gate driving circuit; the level shifter is further configured to convert the low frequency clock control signal into low frequency clock signals and transmit the low frequency clock signals to the first screen gate driving circuit and second screen gate driving circuit; and wherein transmission lines through which the level shifter transmits the clock signals and the low frequency clock signals to the first screen gate driving circuit and the second screen gate driving circuit are independent of each other between the first screen gate driving circuit and the second screen gate driving circuit.

11. The display device according to claim 1, wherein the screen gate driving signal comprises a high level turn-on thin-film transistor switching voltage and a low level turn-off thin-film transistor switching voltage.

12. The display device according to claim 1, wherein in the case where either of the first screen gate driving circuit and the second screen gate driving circuit has a malfunction, the other of the two is operative to function normally for single-sided driving all the gate lines of the display panel.

13. The display device according to claim 1, wherein the first frame start signal and the second frame start signal have the same timing.

14. An overhaul method for a display device, wherein the display device comprises a display panel, a driving circuit, and a power source configured for providing a voltage required by the display panel and the driving circuit;

the display panel comprises screen gate driving circuits configured for receiving a screen gate driving signal output by the driving circuit to drive a gate line in the display panel, and the screen gate driving circuits comprise a first screen gate driving circuit and a second screen gate driving circuit; the first screen gate driving circuit and the second screen gate driving circuit are disposed on two sides of the display panel respectively;

the screen gate driving signal comprises a first frame start signal and a second frame start signal independent of each other; the first frame start signal is configured to control the first screen gate driving circuit, and the second frame start signal is configured to control the second screen gate driving circuit; wherein each of the first screen gate driving circuit and the second screen gate driving circuit is coupled to all gate lines of the display panel;

the overhaul method comprises:

in response to detecting that both the first screen gate driving circuit and the second gate driving circuit are normal, setting both the first frame start signal and the second frame start signal output by the driving circuit to operating levels simultaneously;

in response to detecting that the first screen gate driving circuit is damaged and the second screen gate driving circuit is normal, setting the first frame start signal output by the driving circuit to a non-operating level, and setting the second frame start signal to an operating level; and in response to detecting that the second screen gate driving circuit is damaged and the first screen gate driving circuit is normal, setting the second frame start signal to a non-operating level, and setting the first frame start signal to an operating level;

wherein in the case where either of the first screen gate driving circuit and the second screen gate driving circuit has a malfunction, the other of the two is operative to function normally for single-sided driving all the gate lines of the display panel.

15. The overhaul method for a display device according to claim 14, wherein the driving circuit comprises a timing controller and a level shifter; the timing controller is configured to output a logic level signal, and the level shifter is configured to receive the logic level signal output by the timing controller and convert the logic level signal into a screen gate driving signal;

wherein the logic level signal output by the timing controller comprises a first frame start timing control signal and a second frame start timing control signal independent of each other; the level shifter is configured to receive the first frame start timing control signal to output the first frame start signal, and the level shifter is further configured to receive the second frame start timing control signal to output the second frame start signal.

16. The overhaul method for a display device according to claim 15, wherein the timing controller comprises a first general purpose input/output port and a second general purpose input/output port; the first general purpose input/output port is configured to output the first frame start timing control signal to the level shifter, and the second general purpose input/output port is configured to output the second frame start timing control signal to the level shifter.

17. The overhaul method for a display device according to claim 16, wherein the level shifter comprises a first low frequency port and a second low frequency port; the level shifter is configured to convert the first frame start timing control signal into the first frame start signal, and transmit the first frame start signal to the first screen gate driving circuit through the first low frequency port; and the level shifter is configured to convert the second frame start timing control signal into the second frame start signal, and transmit the second frame start signal to the second screen gate driving circuit through the second low frequency port.

18. The overhaul method for a display device according to claim 14, wherein the logic level signal output by the timing controller comprises a clock control signal and a low frequency clock control signal, and the level shifter is configured to convert the clock control signal into clock signals and transmit the clock signals to the first screen gate driving circuit and second screen gate driving circuit; the level shifter is configured to convert the low frequency clock control signal into low frequency clock signals and transmit the low frequency clock signals to the first screen gate driving circuit and second screen gate driving circuit; and lines through which the level shifter transmits the clock signals and the low frequency clock signals to the first screen gate driving circuit and the second screen gate driving circuit are the same between the first screen gate driving circuit and the second screen gate driving circuit.

19. The overhaul method for a display device according to claim 14, wherein the logic level signal output by the timing controller comprises a clock control signal and a low frequency clock control signal, and the level shifter is configured to convert the clock control signal into clock signals and transmit the clock signals to the first screen gate driving circuit and second screen gate driving circuit; the level shifter is configured to convert the low frequency clock control signal into low frequency clock signals and transmit the low frequency clock signals to the first screen gate driving circuit and second screen gate driving circuit; and wherein transmission lines through which the level shifter transmits the clock signals and the low frequency clock signals to the first screen gate driving circuit and the second screen gate driving circuit are independent of each other between the first screen gate driving circuit and the second screen gate driving circuit.

* * * * *